US006109977A

United States Patent [19]

Baxter et al.

[11] Patent Number: 6,109,977

[45] Date of Patent: Aug. 29, 2000

[54] PRONG FOR ADAPTER PLUG FOR INTERNATIONAL USE

[75] Inventors: Charles S. Baxter; Grant H. Lloyd, both of Lawrenceville, Ga.

[73] Assignee: Motorola, Inc., Schaumburg, Ill.

[21] Appl. No.: 09/132,286

[22] Filed: Aug. 11, 1998

[51] Int. Cl.[7] ..... H01R 13/04

[52] U.S. Cl. ..... 439/693; 439/171; 439/518

[58] Field of Search ..... 439/131, 693, 439/170, 171, 518

[56] References Cited

U.S. PATENT DOCUMENTS

| | | | |
|---|---|---|---|
| 3,377,613 | 4/1968 | Archer . | |
| 3,710,287 | 1/1973 | Eckert . | |
| 5,641,311 | 6/1997 | Chuang | 439/693 |

*Primary Examiner*—Khiem Nguyen
*Attorney, Agent, or Firm*—Philip H. Borrus, IV

[57] ABSTRACT

Described is a plug prong comprising a blade and an anchor where the blade has a section cut from one or both sides of the blade. The cut out section is replaced by plastic and the anchor is covered by plastic except for the electrical contact area. The invention provides increased protection against electrocution of a child.

2 Claims, 3 Drawing Sheets

PRONG FOR ADAPTER PLUG FOR INTERNATIONAL USE

TECHNICAL FIELD

This invention relates in general to power transformers and more particularly to power transformers of the type used with power supplies found in different regions of the world.

BACKGROUND OF THE INVENTION

Power transformers are used to convert an alternating current power supply of the type available in homes, offices, hotels, and the like, via an ordinary wall outlet, to a direct current power supply compatible with electronic devices. These power transformers are used to reduce dependence upon batteries, or to provide charging energy for rechargeable batteries from available alternating current power sources. To provide the regulated power supply, the transformer includes a power converting circuit within the housing having a male connector positioned thereon. The male connector is for connection to a female connector of a main power supply wall outlet.

A difficulty encountered by international travelers is powering their electronic equipment from the main power supplies found in different regions of the world. This difficulty arises because power supplies in different countries have different voltages, currents, and supply frequency characteristics. They also have different wall outlet female connector configurations. Although power converter circuits have been developed which produce a regulated direct current voltage from most main power supply signals found throughout the world, accommodating different female connectors have been more difficult. Therefore, there is a need for an improved international power transformer adapter transfiguration.

DETAILED DESCRIPTION OF THE PREFERRED EMBODIMENT

The present invention is a plug prong comprising a blade and an anchor. The blade has a section cut from one or both sides, and the cut-out section is replaced by plastic. The anchor of the plug prong is covered by plastic except for an electrical contact area. The plug (also called power supplies and power transformers) prong of the present invention may be used advantageously in adapter plugs where the plug prongs rotate from a position flush or below the face of the adapter plug housing to a position where the prongs jut outwardly from the face of the housing. The plastic replacing one or two sections of the blade, and covering the base of the blade helps to prevent children from being shocked when they try to touch the prongs of the plug when it is inserted into a wall outlet. Since the plastic only covers the anchor of the prong, and sections of the sides, it does not inhibit the proper electrical contact between the distal end of the prong and interfere with the female electrical connector in the wall outlet.

Figure 2:
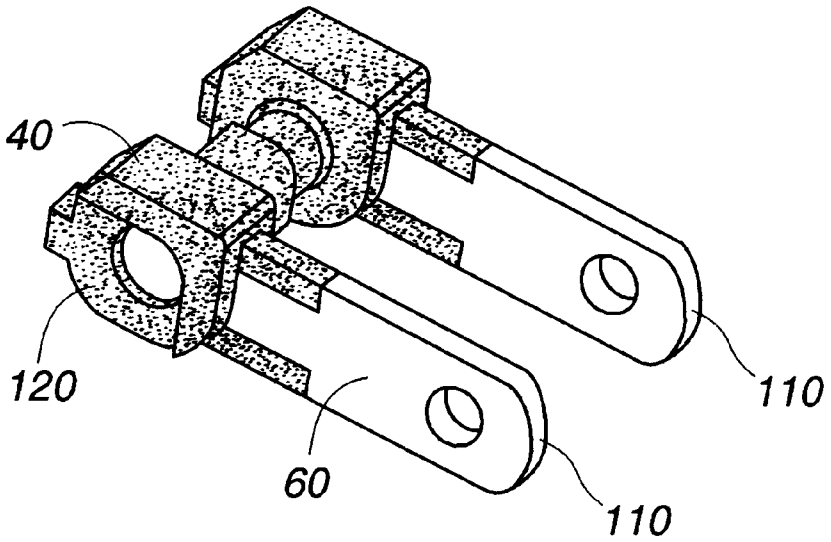
FIG. 2 is a perspective view of the prongs of the present invention.
Figure 1:
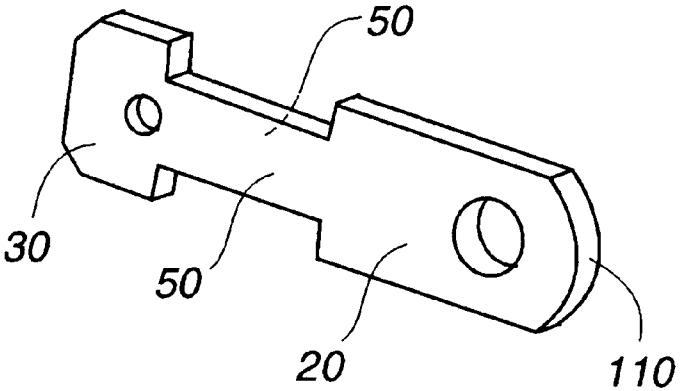
FIG. 1 is a perspective view of a plug blade with sections cut out along both sides of the blade.
Figure 3:
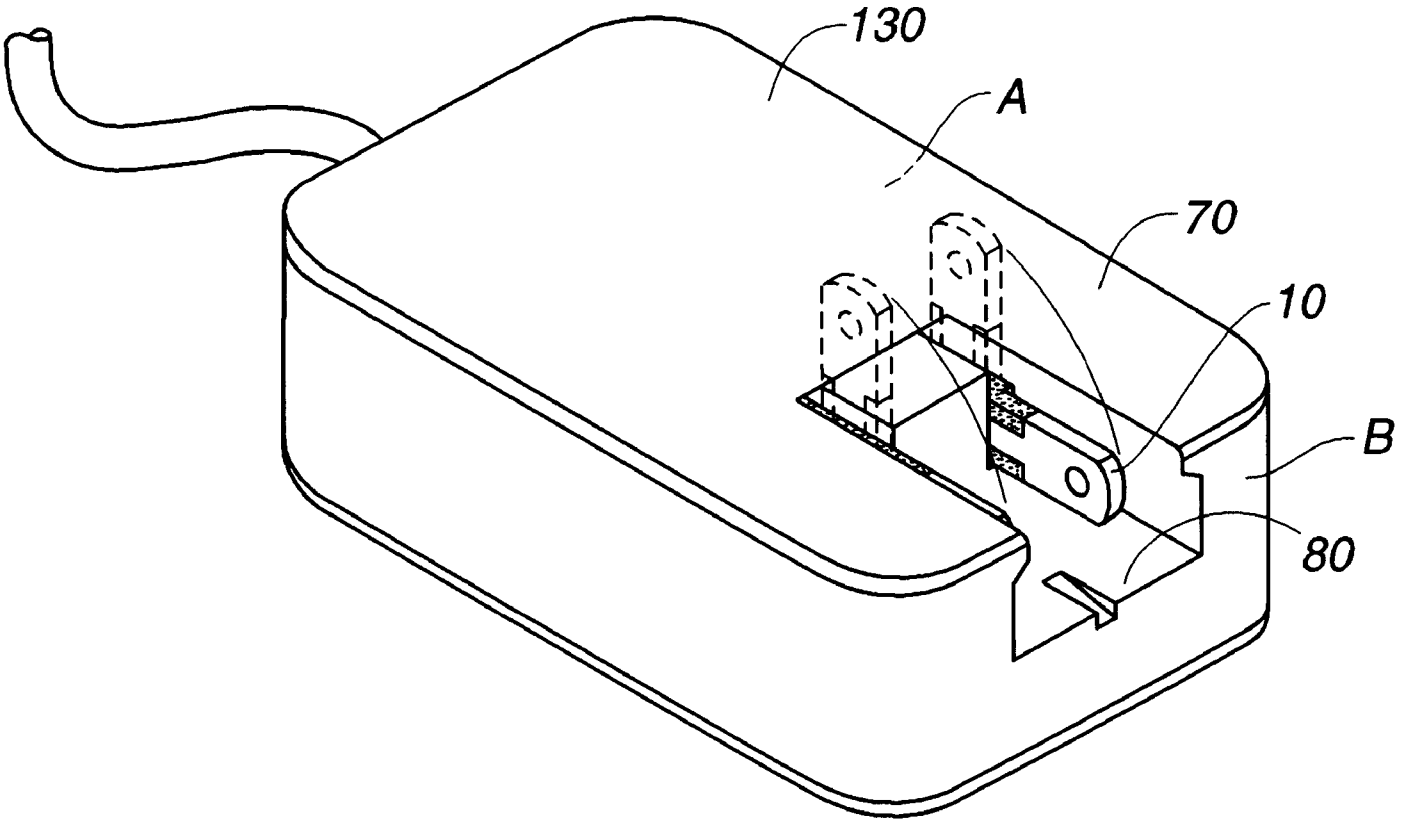
FIG. 3 is a perspective view of the adapter plug incorporating the prongs of the present invention.

FIG. 1 shows the plug prong of the present invention before it is partially covered in plastic. FIG. 1 shows the plug prong (10) of the present invention. Shown is blade (20) with sections (50) cut out along the side of the blade. FIG. 2 shows prong (10) of the present invention. The sections (50) cut out along the sides of the blade (20) have been replaced by plastic (60). The plastic (120) also covers the anchor (30) of the prong (10), except for electrical contact area (40). In this embodiment, the sections (50) cut out along the side of the blade (20) extend from the anchor (30) to about halfway up the blade (20). However, these sections (50) can extend almost to the distal end (110) of prong (10), as long as the sections (50) do not interfere with the electrical contact between the prong (10) and the wall outlet (not shown) is not troubled by this arrangement. FIG. 3 shows the prong (10) of the present invention employed with an adapter plug with a rotating set of prongs (10). An adapter plug with a rotating set of plug prongs is described, for example, in U.S. Pat. No. 5,613,863 entitled "Power Transformer," inventors T. R. Klaus, et al, assigned to Motorola, Inc. Here, plug prongs (10) rotate between position "A" jutting out from the face (130) of the adapter housing (100) and position "B" below the surface of the face (130) of the adapter housing (100). As one can see from FIG. 3, were it not for the plastic inserts (60) and the plastic (120) on the anchor (30), a child's finger or a paper clip (not shown) could insert itself into the recess (80) of the adapter housing (100) and touch a live section of prong (10).

Figure 4:
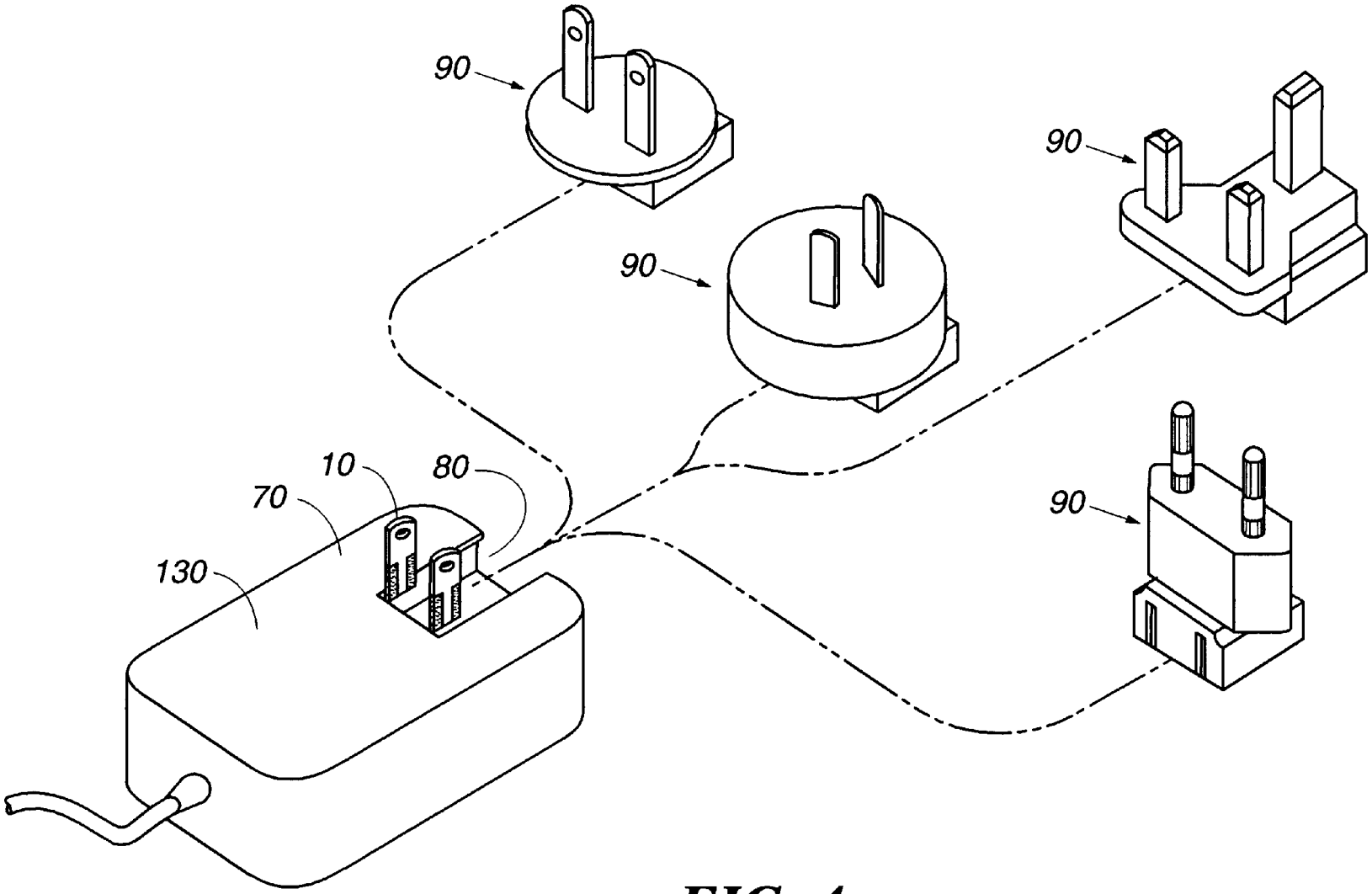
FIG. 4 is a perspective view of an adapter plug using the prongs of the present invention to accommodate different types of international plug configurations.

FIG. 4 shows a flip plug (70) employing the prongs (10) of the present invention used with a variety of international plug adapter configurations (990). Here, prong 10 is rotated into a position below the surface of the face (130) of the adapter plug, and international adapter plugs (90) are slid over the prongs (10). Since the plastic inserts (60) occupy the same volume as the section (50) cut out along side the blade, international adapter plug (90) can be slid over the prong (10) of the present invention, as easily as they can be slid along standard prongs.

Plastic inserts (60) and plastic coating (120) around the anchor may be formed, for example, by injection molding. Any suitably durable, insulating plastic may be used.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An adapter plug comprising a main body and a plug prong, wherein the plug prong comprises a blade and an anchor, wherein the blade has a section cut from one side of the blade, and wherein the cutout section is replaced by plastic, and wherein the anchor is covered by plastic except for an electrical contact area, and wherein the anchor includes a pivot, and wherein the anchor is attached to the main body by means of the pivot, and wherein the pivot permits rotation of the plug prong with respect to the main body of the adapter.

2. An electronic device comprising the adapter plug of claim 1.

* * * * *

UNITED STATES PATENT AND TRADEMARK OFFICE

CERTIFICATE OF CORRECTION

PATENT NO : 6,109,977

DATED : August 29, 2000

INVENTOR(S) : Baxter, et al.

It is certified that error appears in the above-identified patent and that said Letters Patent are hereby corrected as shown below:

On the title page:

Attorney, Agent or Firm, reads "Borrus" should be –Burrus--.

Signed and Sealed this

First Day of May, 2001

*Attest:*

Nicholas P. Godici

NICHOLAS P. GODICI

*Attesting Officer*

*Acting Director of the United States Patent and Trademark Office*